US006493994B1

(12) United States Patent
Lucas

(10) Patent No.: US 6,493,994 B1
(45) Date of Patent: Dec. 17, 2002

(54) RAIN GUTTER SELF-CLEANER

(76) Inventor: Michael Lucas, 146 Quassaic Ave., New Windsor, NY (US) 12553

( * ) Notice: Subject to any disclaimer, the term of this patent is extended or adjusted under 35 U.S.C. 154(b) by 0 days.

(21) Appl. No.: 09/683,819

(22) Filed: Feb. 19, 2002

(51) Int. Cl.[7] ..... E04D 13/076
(52) U.S. Cl. ..... 52/12; 52/11; 210/477
(58) Field of Search ..... 52/11, 12; 15/236.04; 210/477

(56) References Cited

U.S. PATENT DOCUMENTS

| | | | | | |
|---|---|---|---|---|---|
| 471,427 | A | * | 3/1892 | Lavallet | 210/474 |
| 493,697 | A | * | 3/1893 | Fisk | 210/477 X |
| 753,660 | A | * | 3/1904 | Boyer | 52/11 X |
| 2,469,841 | A | * | 5/1949 | Ours | 52/12 |
| 2,841,100 | A | * | 7/1958 | Moller | 52/12 X |
| 2,875,712 | A | * | 3/1959 | Blau | 210/474 X |
| 3,420,378 | A | * | 1/1969 | Turner | 52/12 X |
| 3,740,787 | A | * | 6/1973 | Bowermaster | 52/12 X |
| 3,834,091 | A | * | 9/1974 | Dugan | 52/12 |
| 3,977,135 | A | * | 8/1976 | Hunley, Jr. | 52/12 |
| 4,351,134 | A | * | 9/1982 | Clarkson | 52/12 |
| 4,406,093 | A | * | 9/1983 | Good et al. | 52/12 X |
| 5,095,666 | A | * | 3/1992 | Williams, Jr. | 52/12 X |
| 5,586,837 | A | * | 12/1996 | Udelle | 52/12 X |
| 5,867,945 | A | * | 2/1999 | Scafidi | 52/12 X |
| 5,875,590 | A | * | 3/1999 | Udelle | 52/16 |
| 5,911,659 | A | | 6/1999 | Serano | |
| 5,989,357 | A | * | 11/1999 | Vilhauer et al. | 52/12 X |
| 6,067,755 | A | * | 5/2000 | Maanum | 52/12 |
| 6,240,679 | B1 | * | 6/2001 | Smalara | 52/12 X |
| 6,269,592 | B1 | | 8/2001 | Rutter | |

FOREIGN PATENT DOCUMENTS

| | | | | |
|---|---|---|---|---|
| DE | 3703320 | * | 11/1988 | 52/12 |
| DE | 4023736 | * | 2/1991 | 52/11 |
| DE | 198 15 722 | * | 10/1999 | E04D/13/076 |
| DE | 199 52 823 | * | 5/2001 | E04D/13/076 |
| GB | 2274121 | * | 7/1994 | 52/11 |

* cited by examiner

*Primary Examiner*—Laura A. Callo
(74) *Attorney, Agent, or Firm*—Mark P. White

(57) ABSTRACT

A gutter assembly is formed from a series of identical sections, each between twelve and eighteen inches in length. Each section is attached to one or two adjacent sections at the ends, and the final assembly attached to the eaves, soffit, or fascia of the house in the same manner as the prior art rain gutter. Each section has a section body, with an interior surface. Within the interior surface is a water-permeable screen, disposed in close proximity to the section outer housing. A discharge handle is provided to raise the screen from the interior surface, and rotate the screen in a manner such that any debris captured by the screen will be expelled from the gutter section. The handle is accessible from the grounds by means of a rod with a hook which engages a loop at the end of the handle. Each section contains a discharge passage on each end, except that the two extreme ends of the assembly contain an outer end which is sealed off, and further contain provisions for downspouts.

12 Claims, 10 Drawing Sheets

RAIN GUTTER SELF-CLEANER

BACKGROUND OF THE INVENTION

It is well known in the construction of dwelling houses to locate rain gutters at the eaves of the roof to collect rain water and conduct it, through downspouts located at specific points along the gutter, to conduct the water to a specific location. The gutter thus provides a means to avoid the dripping of the water all along the edge onto people below, and avoids the directing an excessive accumulation of water into undesirable locations, such as the foundations of the house, flower beds, etc. The downspouts often lead out onto dry wells to conduct the water safely to areas which do not provide threats to the house's foundation, or the grounds surrounding.

However, it i s further well known that such rain gutters are susceptible to clogging with leaves and other types of natural debris, which prevents the gutters from operating efficiently, or, in many instances, prevents them from operating at all. In addition, a clogged gutter, left clogged during the winter months, can cause or exacerbate ice dams, which cause leakage in the vicinity of the eaves into the interior of the house.

When clogging occurs, the owner of the house or his servant are generally required to ascend to the gutter, often using a ladder, and remove the accumulated debris by hand, an unpleasant, messy, and sometimes dangerous job.

A number of solutions to this problem of rain gutter clogging have been proposed, most of which involve shields or guards above the gutters which prevent most types of debris from entering the rain gutter. Examples of these covers, or guards, include U.S. Pat. Nos. 6,269,592, 6,098,334, 6,016,631, 5,660,001, 5,911,659, 5,565,118, 4,435,925, and 4,404,775, these covers offer limited utility, and suffer from several major drawbacks.

First, due to the wide variety of gutter cross sectional shapes in use, it is difficult to design a universal cover that can be used on a wide variety of different gutter shapes. More importantly, however, debris, especially leaves and branches, can accumulate atop the cover, and fail to enter the gutter at all, thus defeating the purpose of the gutter. Furthermore, the cover prevents the natural flushing action of rainwater falling into the gutter, since the cover inhibits and attenuates the force of rainwater falling into the gutter.

The present invention avoids these problems by effecting a different approach.

The current invention uses a gutter cleaner which is essentially a screen or strainer permeable to water which lays within the gutter. A handle or pivot arm is accessible from the front of the gutter, and allows the user to rotate the screen above and forward of the gutter, dumping accumulated debris from the gutter onto the earth beneath. A series of such screens are affixed to the gutter, so that the user may periodically remove debris accumulating in the gutter by simply pulling on each handle in turn.

In another embodiment, a rain gutter assembly is constructed out of a series of adjacent, identical sections, each section having a length of between two and two and three feet in length. Attached to the inside of each section is a set of strainers, typically three in number, which conform to the inside of the rain gutter, and which collect the debris within the gutter. Each section has a discharge handle which, when pulled down, causes the set of strainers to rotate out of the gutter housing, and "dump" the contents onto the ground below. Using the discharge handle, the strainers can be return to their quiescent position, within the housing of the gutter section.

In ranch, or other styles of single-story houses, the owner may be able to reach the discharge handle without climbing a ladder, either directly or by use of a rod or stick which hooks into a loop at the end of the handle.

The gutter assembly thus constructed attaches to the house in the same was as the standard, prior-art gutter, and provides a inexpensive and save way to keep the gutter clog-free.

SUMMARY OF THE INVENTION

It is the object of the present invention to provide a gutter section which can be assembled into a gutter assembly by attachment to other gutter sections, creating a rain gutter for a residence which can be easily cleaned of debris by the user with a minimum of effort, and without requiring the climbing of a later of other means of ascending the side of the house.

It is an alternative object of the present invention to provide a gutter cleaner which can be installed onto a gutter assembly already in place, which can be easily cleaned of debris by the user with a minimum of effort, and without requiring the climbing of a later of other means of ascending the side of the house.

In accordance with one aspect of the present invention, A self-cleaning gutter section includes a section body having an interior surface, a water-permeable screen within the interior surface and disposed in close proximity thereto, and means to rotate the screen out of the interior surface in a manner such that any debris captured by the screen will be expelled from the gutter section.

In accordance with a second aspect of the invention, the screen is attached to the section body by one or more hinges.

In accordance with a third aspect of the invention, t the means to rotate the screen further includes a handle having a front end, a back end, and a pivot point.

In accordance with a fourth aspect of the invention, the screen has a posterior member, in proximity to a back wall of the gutter section, and an anterior member, in proximity to an anterior wall of the gutter section. The handle is further attached at its back end to the posterior member, and the pivot point of the handle is disposed in proximity to a front wall of the gutter section.

In accordance with a fifth aspect of the invention, the screen further includes a bottom member, having a front edge and a back edge. The bottom member is, in turn, rotatably attached at its front edge to the anterior member, and at its back edge to the posterior member.

In accordance with a sixth aspect of the invention, each section has two end walls, one or more of which contain one or more orifices to permit water to communicate with an adjacent section.

In accordance with a seventh aspect of the invention, each end wall is attached to an adjacent end wall by either screws, rivets, or adhesives.

In accordance with an eighth aspect of the invention, a flange is disposed in proximity to the orifice at one end of the section, which matingly attaches to an orifice of an adjacent section, making a watertight connection between the adjacent sections.

In accordance with an eighth aspect of the invention, the pivot point contains a pivot ring attached, which rests on a lip of the front wall of the section.

In accordance with an eighth aspect of the invention, a multiplicity of sections are joined, each section joined at one end to an adjacent section forming a unitary structure as a result.

In accordance with a ninth aspect of the invention, a rain gutter cleaner, mountable on a building rain gutter which has a rain gutter body and an interior surface includes a water-permeable screen, fitting within the interior surface; and disposed in close proximity thereto, means to rotatably affix the screen to the body, and means to rotate the screen out of the interior surface in a manner such that any debris captured by the screen will be expelled from the gutter section.

In accordance with a tenth aspect of the invention, a self-cleaning gutter includes a rain gutter body with an interior surface, a multiplicity of water-permeable screens, each within the interior surface; and disposed in close proximity thereto, and means to rotate each screen out of the interior surface in a manner such that any debris captured by one of the screens will be expelled from the gutter section.

According to a final aspect of the invention, the rain gutter assembly includes one or more down spouts affixed to the bottom wall of one or more of the sections.

BRIEF DESCRIPTION OF THE DRAWINGS

These, and further features of the invention, may be better understood with reference to the accompanying specification and drawings depicting the preferred embodiment, in which.

DETAILED DESCRIPTION

Figure 2:
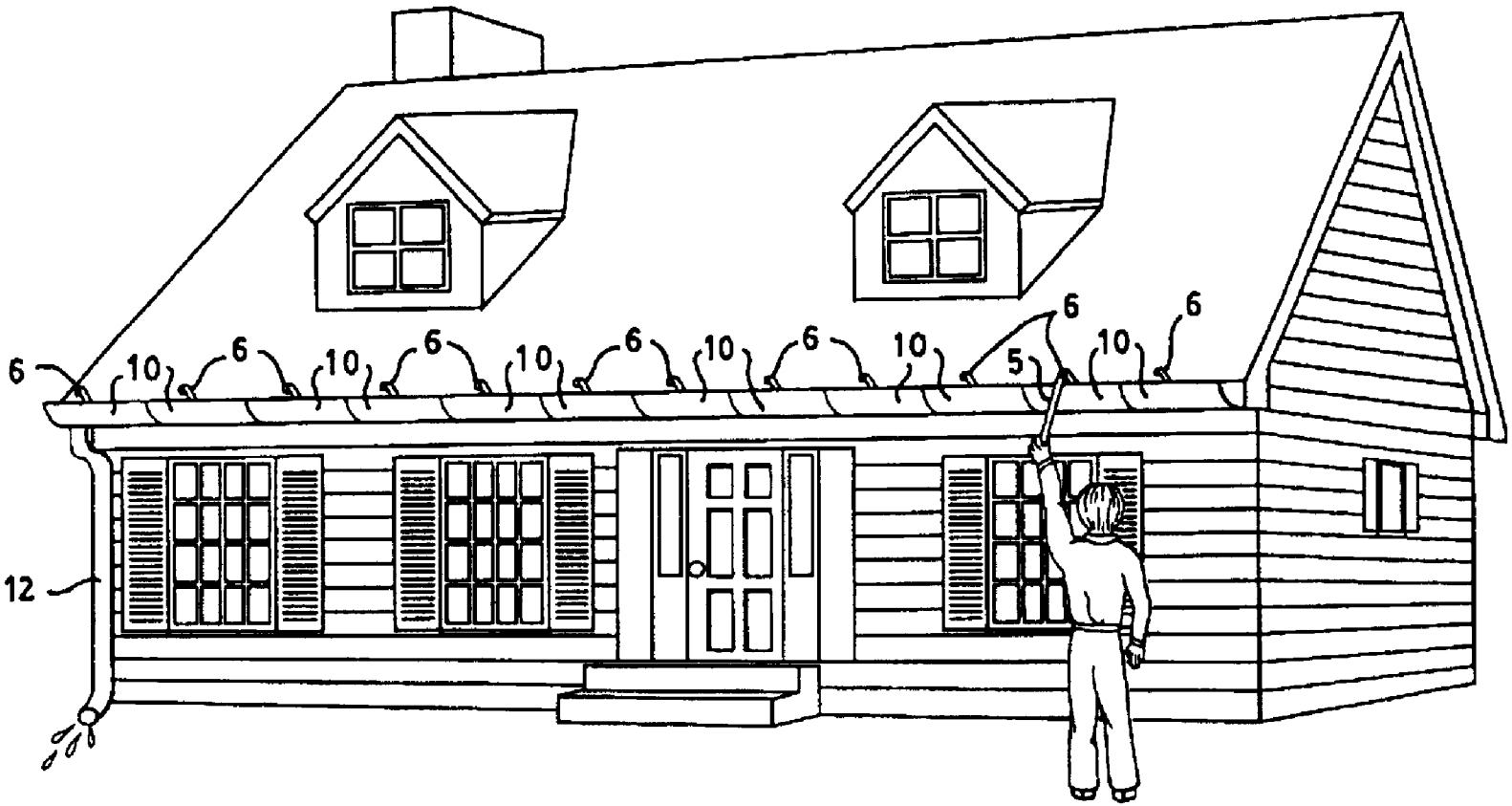
FIG. 2 depicts a perspective view of the gutter sections, attached together, to form a gutter, attached to the soffit of a house.

The purpose of the present invention is to allow a homeowner to easily and efficiently clean out the debris which accumulates in the rain gutters of his house, typically without having to ascend the side of the house using a ladder. In one embodiment of the present invention, the gutter is formed by a series of gutter sections, each of which is connected at the side to an adjacent gutter section, and at the back to the house itself, thereby forming a complete gutter assembly, as shown in FIG. 2. In another embodiment, the gutter is formed of a single body forming the entire assembly.

Figure 1:
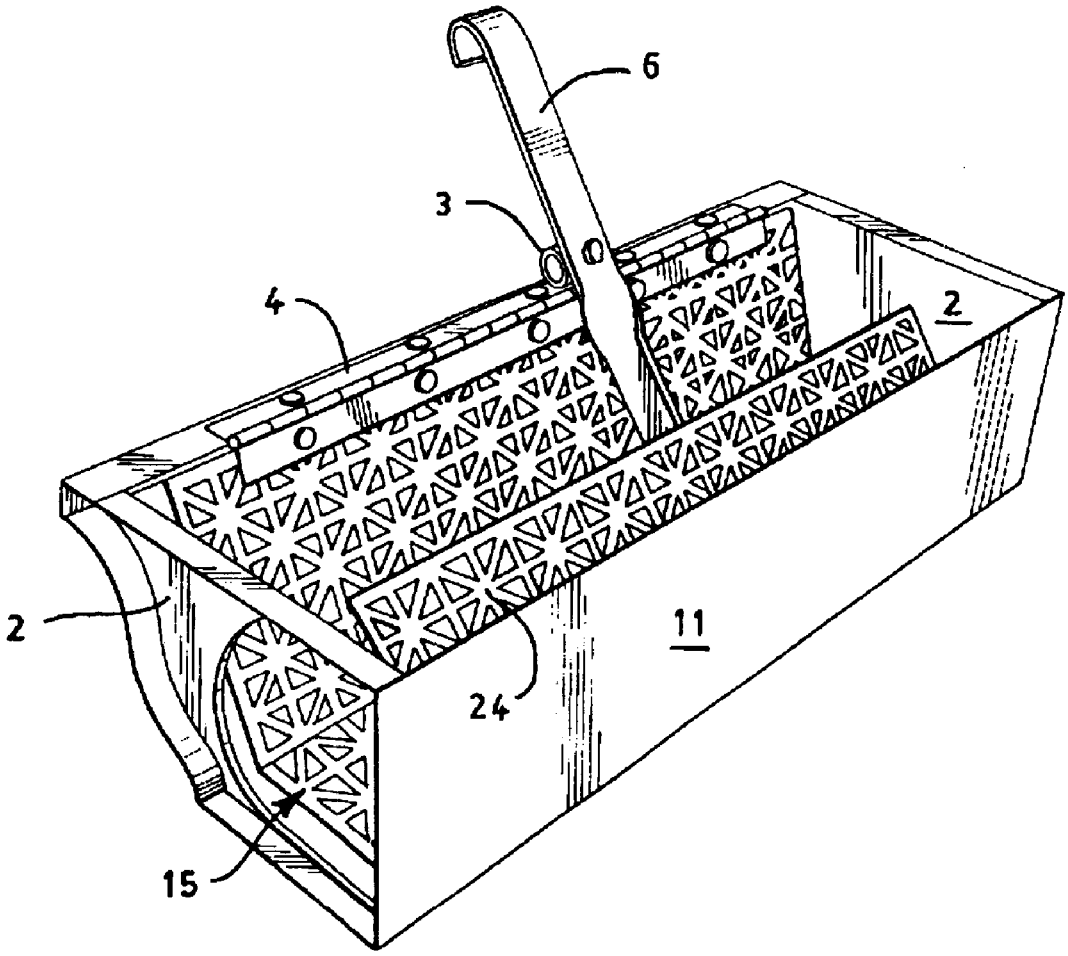
FIG. 1 depicts a perspective view of the gutter section, viewed from the back.
Figure 9:
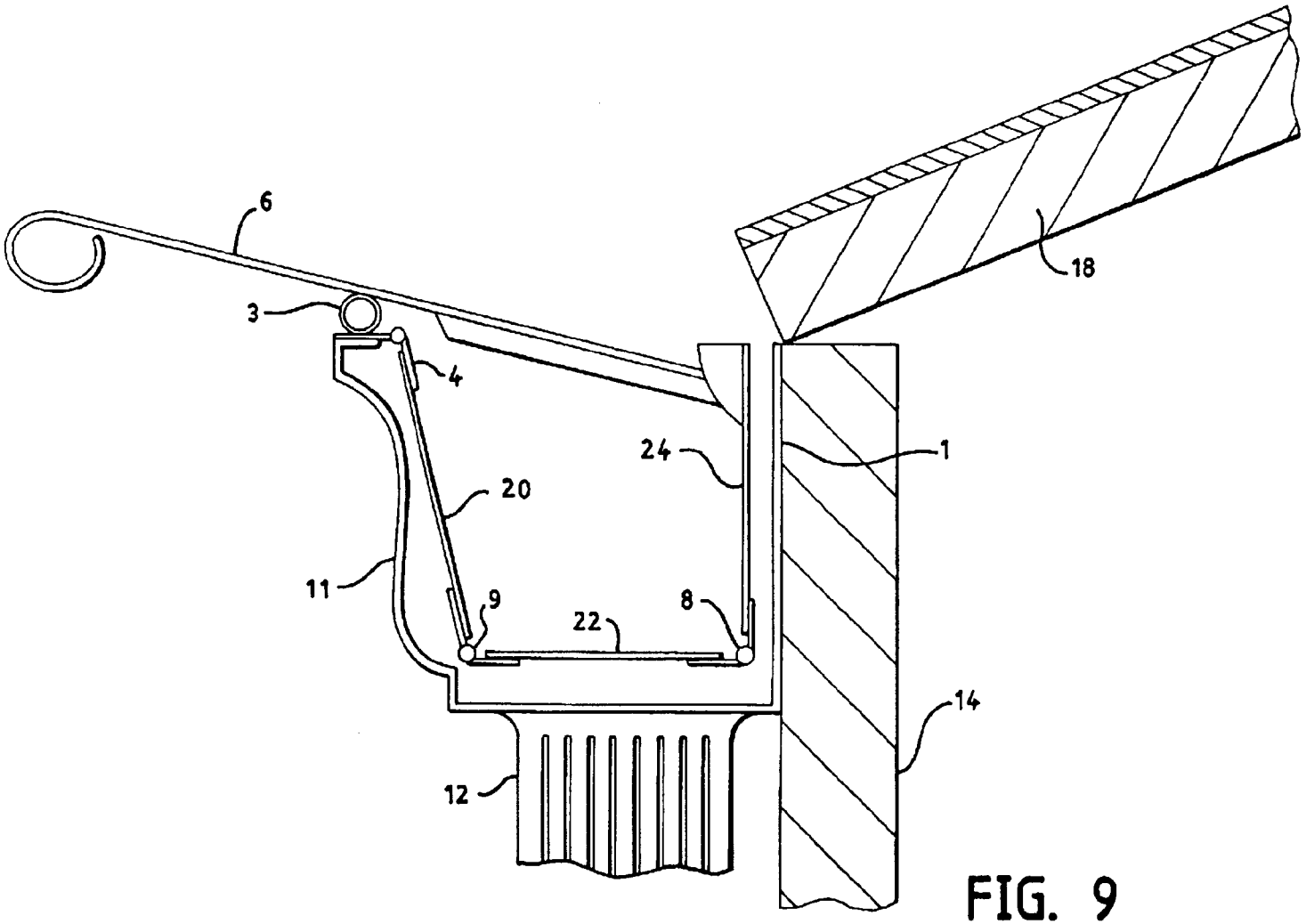
FIG. 9 depicts a cross section of the gutter section, and showing the attachment of the back of the gutter section to the siding of the house, and further showing the three screen sections within the outer housing of the gutter section.

The invention can be understood by first referring to FIG. 1, which depicts a perspective view of a gutter section. The section bears a resemblance to the commonly-used gutters attached to the soffits or fascia of a house in proximity to the lower edge of the roof 18, or to the siding 14 itself, where the roof joins with the siding, as shown in FIG. 9.

FIG. 2 depicts the gutter 10 sections joined to form a continuous and integral rain gutter, with discharge via the downspout 12 attached to one of the gutter sections, and the sections attached to the soffit, rather than the siding of the house. In FIG. 2 the man in the drawing is holding a rod in order to access one of the handles 6 of the gutter sections.

Referring again to FIGS. 1 and 9, each gutter section consists of a front housing 11, and a rear housing 11. Set within the housings are a front screen 20, a bottom screen 22, and a rear screen 24. The front screen is attached to the front housing by a hinge 4 mounted on the top lip of the front housing, and to the bottom screen 22 by another hinge 9. The bottom hinge, in turn, is attached to the back screen 24 by a third hinge 8.

The discharge is via a downspout 12, which is attached to the bottom of one of the sections.

Figure 8:
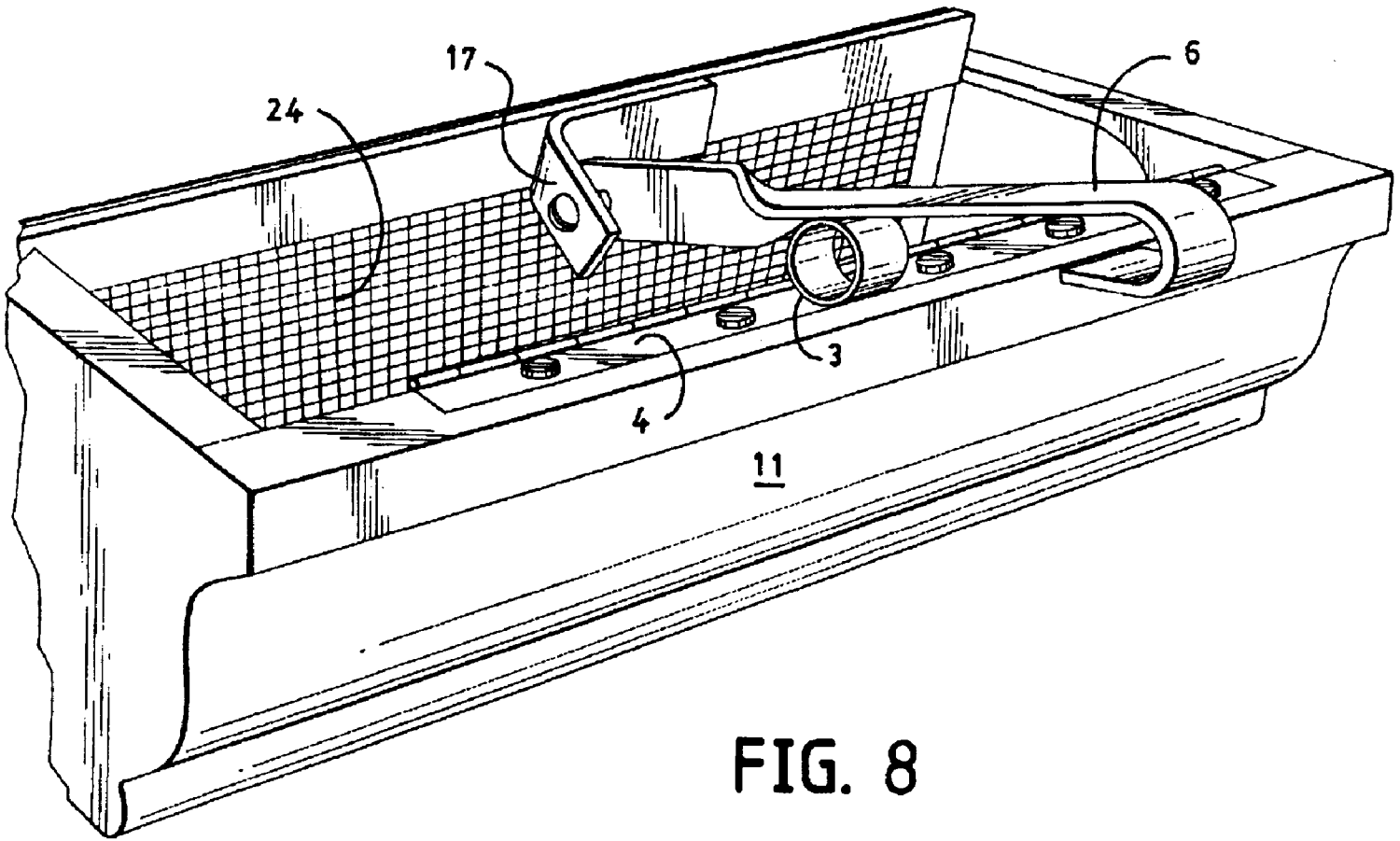
FIG. 8 depicts a perspective view of the gutter section, viewed from the front and side, with a fine-grid strainer, and revealing the detail of the handle pivot ring.

Still referring to FIG. 9, the discharge handle 6, has attached to it a pivot ring 3, which normally rests on the portion of the hinge 4 which rests on the upper lip of the front housing 11, but is not actually attached. This detail is further shown in the perspective view of FIG. 8, which further depicts the attachment of the handle to the rear screen 24 by means of bracket 17.

Referring now to FIG. 1, some further details of the gutter section are revealed, including the side passages 15, which are located on each side housing 2 of the gutter section, and permit water to flow freely between sections. The screen of FIG. 1 has a rough grid, permitting very fine particles to escape through the screen. These particles will be washed out of the gutter assembly by the action of the water flow.

FIG. 1 depicts the position of the handle whereby the back screen 24 is just beginning to lift out of the housings.

Figure 5:
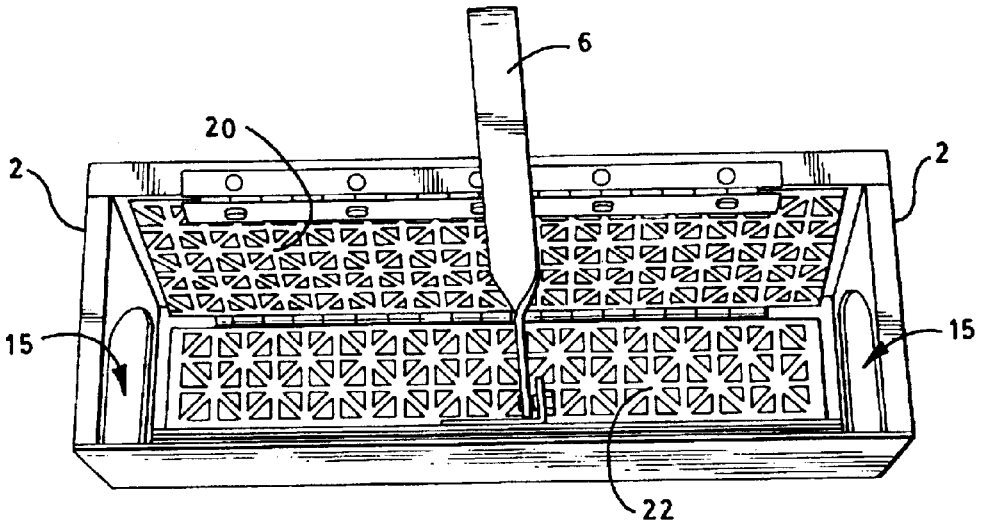
FIG. 5 depicts a perspective view of the gutter section, viewed from the top.
Figure 6:
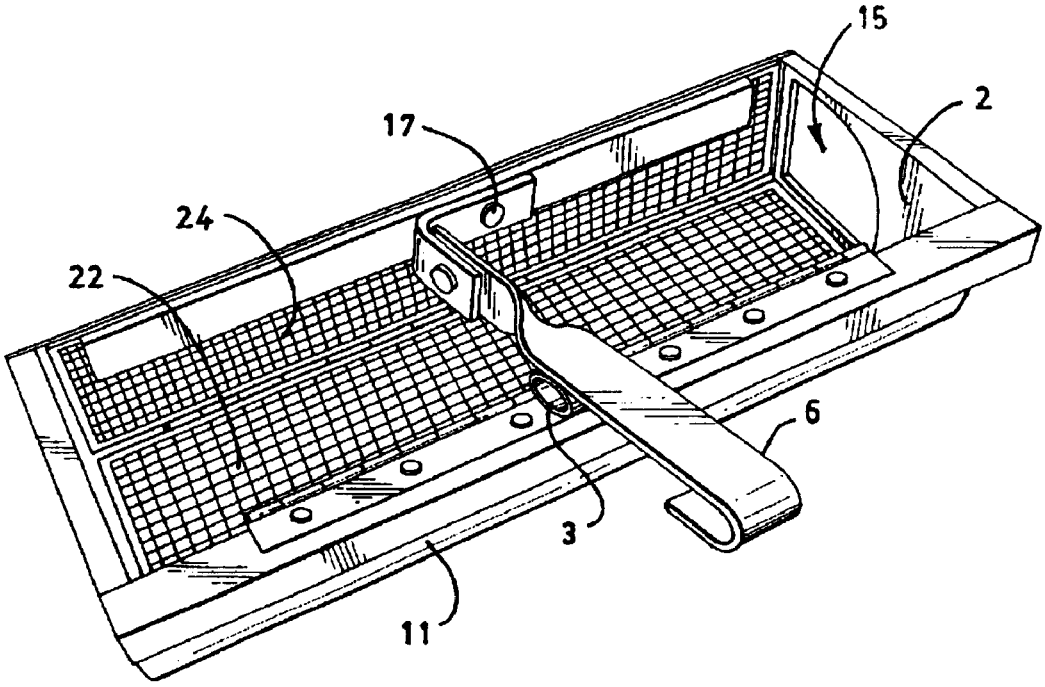
FIG. 6 depicts a perspective view of the gutter section, viewed from the top, and showing the connection of the handle to the rear screen section.

FIGS. 5 and 6 further reveal details of the gutter section with the screens in their fully retracted position. FIG. 5 shows the side passages 15 in each side housing 2. FIG. 6 also reveals the connection bracket 17 by which the discharge handle 6 is attached to the rear screen 24.

Figure 3:
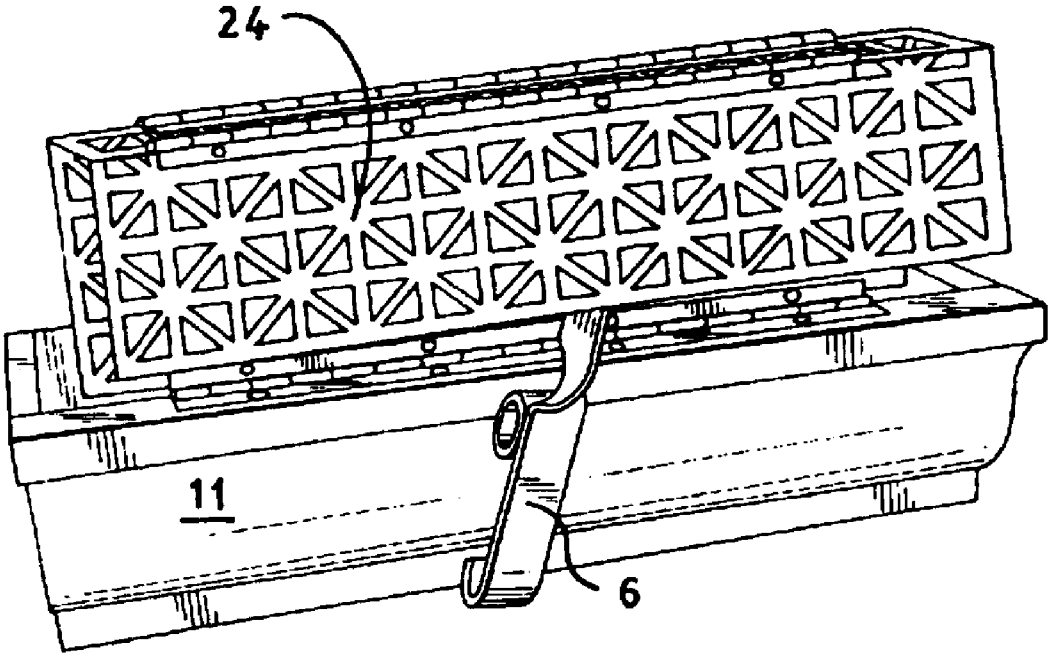
FIG. 3 depicts a perspective view of the gutter section, viewed from the front, with the internal strainer sections raised to a position to eject the contents of the section.
Figure 4:
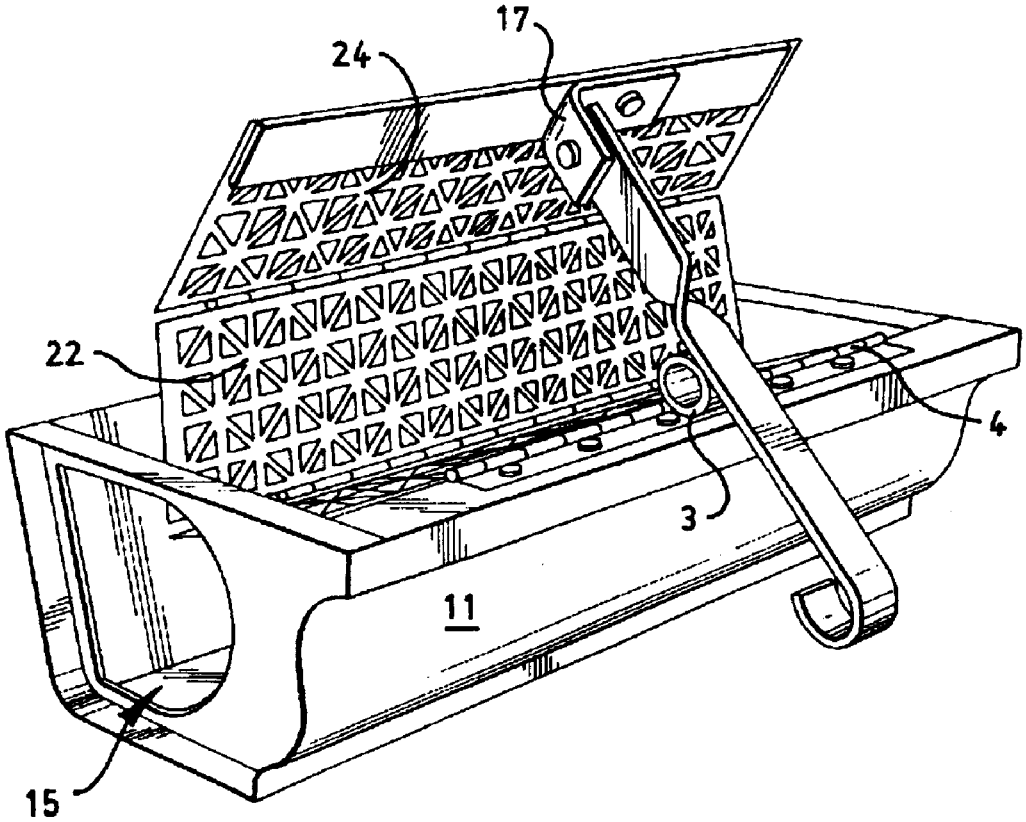
FIG. 4 depicts a perspective view of the gutter section, viewed from the front and side, with the strainer raised to an intermediate position.
Figure 7:
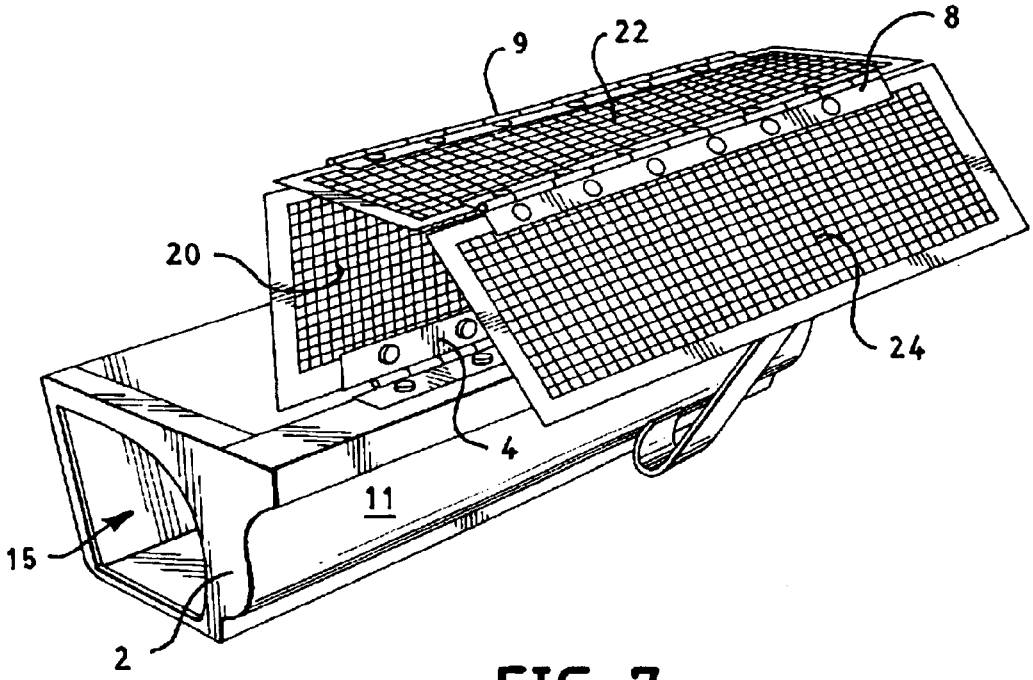
FIG. 7 depicts a perspective view of the gutter section, viewed from the front and side, with fine-grid internal strainer sections raised to a position to eject the contents of the section.

FIGS. 3 and 7 depict a gutter section with the screen fully extended, into the discharge position. In FIG. 3, the view is from the front, and shows the discharge handle 6 in the full discharge position, with the pivot ring on the front edge of the lip of the front housing. The screens have been fully rotated out of the housings, and remain attached only by hinge 4. The rear screen 24 has been rotated to a position whereby the contents of the screen will be discharge by the action of gravity.

It has been found that the optimum length for the sections is between two and three feet, with each section joined to adjacent sections by attachment at the side housings, by screws, rivets, or similar fasteners, or by adhesives. A flange in one side of each side housing mates into the adjacent side passage, so that there is no leakage at the joints between the gutter sections. Alternatively, gaskets can be used at the ends of the sections to insure water-tight seals. Each section is separately joined to the soffit, fascia, or siding of the house, either by fasteners or by the use of adhesives.

When any one or more of the sections becomes full of debris, the section is cleared by pulling down on the discharge handle. The user may either ascend by ladder so that he may reach the handle, or, in the case of a ranch house or other building where the gutters are relatively close to the ground, do so by using a rod or other tool which hooks onto the discharge handle, as shown in FIG. 2.

Figure 10:
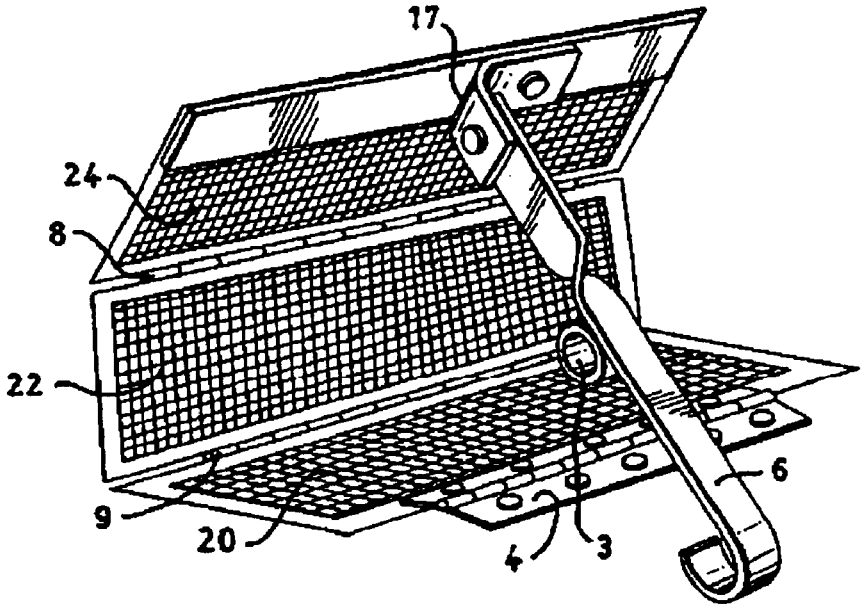
FIG. 10 depicts a perspective view of the gutter cleaner in kit form, showing a single section of the kit, typically two to three feet in length, opened as when the. debris is being discharged.
Figure 11:
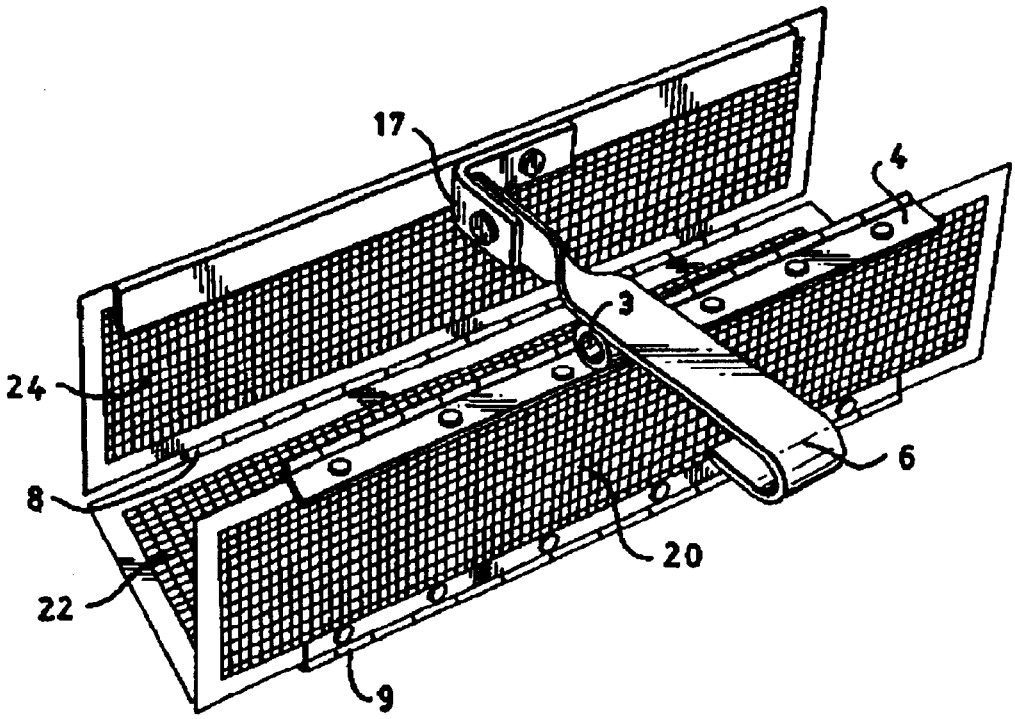
FIG. 11 depicts another view of the gutter cleaner in kit form, also in perspective view, closed, as when in repose within the gutter itself.

In a further embodiment of this invention, the gutter cleaner is provided in the form of a kit which mounts on an existing gutter installation. This embodiment may be understood by referring now to FIGS. 10 and 11.

Referring now to these figures, the kit is seen to include the front screen, rear screen, and bottom screen sections 20, 24, and 22, respectively, which are connected to each other by means of the hinges 8 and 9. The screen sections, when attached by means of the hinges, make up a screen assembly. The screen assembly is attached to the pre-installed gutter by means of hinge 4, which is attached to the screen assembly as provided in the kit, but which then must be attached to the gutter by means of adhesives or by fasteners. The preferred method of attachment is by self-tapping sheet metal screws.

The kit further includes the handle 6, which is attached to the screen assembly by means of bracket 17, which is rigidly attached to the rear screen 24, as shown. The handle rotates at the point where it attaches to the bracket 17. The pivot ring 3 is rigidly attached to the underside of the handle, at a point about half-way between the two ends of the handle, where it will rest on the hinge 4 which attaches to the gutter body.

The screen assembly provided in kit form is typically two to three feet in length, as with the earlier embodiment which provides a pre-fabricated gutter section containing the gutter cleaning screens.

In a still further embodiment of this invention the gutter is provided in sections which exceed the two to three feet of the prior embodiments. In some cases, a single gutter section may extend to the entire length of the roof. In this embodiment, the single gutter section will be provided with a series of gutter cleaning assemblies, each containing the screen assembly as described above, and each such screen assembly further including the handle attached to the rear screen, and containing the pivot ring. This embodiment provides the same effect and operation as the kit embodiment, described above, the only difference being that in the presently-described embodiment the end user is not required to install the kit, but purchases the gutter with the kit already installed.

It will be apparent that improvements and modifications may be made within the purview of the invention without departing from the scope of the invention defined in the appended claims.

What is claimed is:

1. A self-cleaning gutter section which comprises;

(a) a section body, comprising an interior surface;

(c) a handle having a front end, a back end, and a pivot point;

(d) two end walls, one or more of which contain one or more orifices to permit water to communicate with an adjacent section;

(b) a water-permeable screen, within the interior surface, attached to the section body by one or more hinges, and further comprising:

(i) a posterior member, in proximity to a back wall of the gutter section, and (ii) an anterior member, in proximity to an anterior wall of the gutter section, (iii) a bottom member, having a front edge and a back edge, the bottom member rotatably attached at its front edge to the anterior member, and at its back edge to the posterior member, and wherein the handle is attached at its back end to said posterior member, and the pivot point of the handle is disposed in proximity to a front wall of the gutter section, so that any debris captured by the screen may be expelled from the gutter section.

2. The section of claim 1, wherein each end wall is attached to an adjacent end wall by means comprising a member of the group which constitutes screws, rivets, and adhesives.

3. The section of claim 2, further comprising a flange disposed in proximity to the orifice at one end of the section, the flange matingly attachable to an orifice of an adjacent section, making a water-tight connection between the adjacent sections.

4. The section of claim 3, wherein the pivot point further comprises a pivot ring attached thereto, which rests on a lip of the front wall of the section.

5. A rain gutter, constituting a multiplicity of sections, each in accordance with the section described in claims 1 or 2 or 3 or 4, and wherein each section is attached at one end to an adjacent section forming a unitary structure thereby.

6. The rain gutter of claim 5, comprising one or more down spouts affixed to the bottom wall of one or more of the sections.

7. A rain gutter, constituting a multiplicity of sections, wherein each section is attached at one end to an adjacent section forming a unitary structure thereby, and wherein each section further comprises:

(a) a section body, comprising an interior surface;

(b) a water-permeable screen, within the interior surface, and disposed in close proximity thereto, and (c) means to rotate the screen out of the interior surface in a manner such that any debris captured by the screen will be expelled from the gutter section.

8. The rain gutter of claim 7 wherein said screen is attached to the section body by one or more hinges.

9. The rain gutter of claim 8, wherein the means to rotate the screen further comprises a handle having a front end, a back end, and a pivot point.

10. The rain gutter of claim 9, wherein the screen has a posterior member, in proximity to a back wall of the gutter section, and an anterior member, in proximity to an anterior wall of the gutter section, and wherein the handle is attached at its back end to said posterior member, and wherein the pivot point of the handle is disposed in proximity to a front wall of the gutter section.

11. The rain gutter of claim 10, wherein the screen further comprises a bottom member, having a front edge and a back edge, the bottom member rotatably attached at its front edge to the anterior member, and at its back edge to the posterior member.

12. A self-cleaning gutter which comprises:

(a) a rain gutter body, further comprising an interior surface;

(b) a multiplicity of water-permeable screens, each screen attached to the rain, gutter body by one or more hinges, and each screen within the interior surface; and (c) for each screen, a handle having a front end, a back end, and a pivot point which rotates the corresponding screen out of the interior surface, and wherein:

each screen has a posterior member, in proximity to a back wall of the gutter section, an anterior member, in proximity to an anterior wall of the gutter section, and a bottom member, having a front edge and a back edge, the bottom member rotatably attached at its front edge to the anterior member, and at its back edge to the posterior member;

each handle is attached at its back end to said posterior member, and the pivot point of the handle further comprises a pivot ring attached thereto, which rests on a lip of the front wall of the gutter body, and is disposed in proximity to a front wall of the gutter body, so that any debris captured by one of the screens will be expelled from the gutter section when the handle is rotated.

* * * * *